US005211032A

United States Patent [19]

Cheng

[11] Patent Number: 5,211,032

[45] Date of Patent: May 18, 1993

[54] ADJUSTABLE EARRING POST

[75] Inventor: Mark Cheng, San Francisco, Calif.

[73] Assignee: Peony Fine, Jewelry, Inc., San Francisco, Calif.

[21] Appl. No.: 771,282

[22] Filed: Oct. 3, 1991

Related U.S. Application Data

[63] Continuation-in-part of Ser. No. 564,014, Aug. 7, 1990, abandoned.

[51] Int. Cl.[5] ..... A44C 7/00

[52] U.S. Cl. ..... 63/12

[58] Field of Search ..... 63/12, 13

[56] References Cited

U.S. PATENT DOCUMENTS

| | | | |
|---|---|---|---|
| 263,755 | 9/1882 | Braverman | 63/12 |
| 4,688,400 | 8/1987 | Chioffe | 63/12 |
| 4,719,544 | 1/1988 | Smith | 63/12 |
| 4,781,036 | 11/1988 | Erickson | 63/12 |
| 4,783,974 | 11/1988 | Hernandez | 63/12 |
| 4,854,132 | 8/1989 | Blumkin et al. | 63/12 |
| 4,993,240 | 2/1991 | Pounder | 63/12 |
| 5,044,176 | 9/1991 | King | 63/12 |
| 5,156,023 | 10/1992 | Bevolo | 63/20 |

*Primary Examiner*—Peter M. Cuomo
*Assistant Examiner*—Michael J. Milano
*Attorney, Agent, or Firm*—Charles E. Townsend, Jr.

[57] ABSTRACT

An earring construction for pierced ears includes a main body or frame for supporting a post to project through the pierced ear lobe. Vertically spaced receptors, each capable of receiving and retaining the post, are provided or formed in the back side of the frame whereby in fitting an earring to an individual user, with the earring display side or ornament at least partially overlying the ear lobe, the post may be moved relatively upwardly or downwardly in order to have the earring hang at the optimum position and desired angle in reference to the vertical plane of the ear lobe.

3 Claims, 1 Drawing Sheet

ADJUSTABLE EARRING POST

BACKGROUND OF THE INVENTION

This application is a continuation in part of my earlier application, Ser. No. 07/564,014, filed Aug. 7, 1990, about to become abandoned in favor of this application.

FIELD OF THE INVENTION

This invention relates to an improved earring construction, and more particularly to a new and improved earring for pierced ears having a vertically adjustable inwardly extending post to project through a pierced ear lobe to permit upward or downward mounting of the earring relative to a user's ear lobe.

DESCRIPTION OF THE RELEVANT ART

Conventional earrings for mounting to pierced ears consist basically of a frame to which is rigidly and immovably mounted an inwardly projecting post to project through the pierced lobe in conjunction with a suitable locking device for mounting on the inner end of the post after it is projected through the pierced lobe. The locking device functions to prevent the post from slipping or falling out of the lobe during ordinary wear.

According to conventional design, the post is fixed in one location to the back of the main body or frame of the earring. From this fixed location, the post projects generally perpendicularly inwardly for projection through the pierced ear lobe. Because of both the fixed location of the post, and its fixed perpendicular angularity in reference to the vertical plane of the body or frame of the earring, the same earring may properly fit or "hang" from one person's ear lobe but not from another's. The reason for this is that all ear lobes are not only of different shapes, sizes and dimensions, but some people's lobes depend downwardly from the ear at different angles of vertical inclination.

For example, one individual's lobe may, from an appearance standpoint, angle inwardly toward the user's neck, whereas another individual may have lobes that do in fact, or at least appear to, angle downwardly outwardly from the user's neck.

In order to fit and properly a pair of earrings having any flattened surfaces or frames should normally give the appearance of being disposed substantially parallel to each other in a substantially vertical plane, as distinguished from the appearance of looking skewed in reference to each other, or tilted from vertical when the user's head and face are upright and looking straight ahead. Of equal importance is that the earring should not hang too high or too low on the ear lobe—a matter of both aesthetic judgment as well as wearer's comfort.

Objects and Advantages of Present Invention

A principal object and advantage of the present invention is to provide an earring for pierced ears of a type in which the display side or ornamment overlies or partially overlies the user's ear lobe and in which means are provided for adjustably mounting the post of the earring in any one of a selected plurality of vertically spaced positions to permit positioning of the earring relatively upwardly or downwardly in reference to the user's pierced ear lobe; and whereby the position and vertical plane of the earring can be varied to most attractively fit the earring to a particular user's ear lobe.

A more specific object of the invention is to provide an improved earring construction of the type presenting a more or less flattened surface body or main frame, the inner side of which is provided with a plurality of receptors or connectors into any one of which the post of the earring can be mounted so as to best accommodate and fit the particular ear lobe of an individual user.

Other objects and advantages are that the invention may be adapted to, or incorporated in, virtually any type of earring construction or design and that the same may be manufacture of the article without visually detracting from the design of the display portion of the earring itself. Further, the manufacturer can be accomplished expeditiously and inexpensively by conventional means and equipment known to persons skilled in the art.

DETAILED DESCRIPTION OF THE PREFERRED EMBODIMENT

Figure 1:
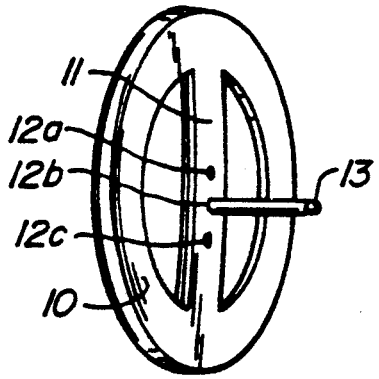
FIG. 1 is a perspective view of the back side of a main body or frame of an earring embodying the invention.

Referring more particularly to the drawing, FIG. 1 discloses by way of example a ring type main body 10 which is provided with a diametrically oriented post-supporting frame member 11. The frame member 11, in actual wear, will define the vertical access of the earring.

The frame member 11 is shown as provided with three vertically spaced female receptors **12*a*, 12*b* and 12*c* into any one of which may be mounted a conventional post 13**.

Figure 2:
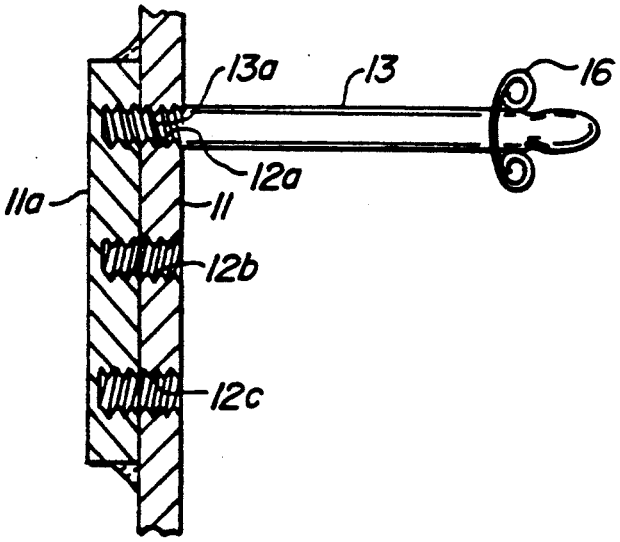
FIG. 2 is an enlarged fragmentary vertical sectional view of the portion of the earring frame with three vertically spaced female receptors and showing the earring post positioned in one of the three.

FIG. 2 is an enlarged sectional fragmentary view of the frame member 11 which shows how the member at that portion of its length where the receptors are to be located may be reinforced with a back-up plate **11*a* that is shown soldered or otherwise rigidly attached to the main frame member 11**.

FIG. 2 also specifically discloses that the receptors may be formed as three female threaded holes adapted to threadedly engaged the male threaded end **13*a* of the post 13**.

Figure 3:
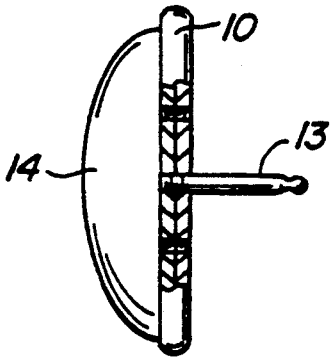
FIG. 3 is a vertical side elevational view of an earring having a gem stone mounted to its obverse side and showing portions of the frame broken away in section.

FIG. 3 discloses a vertical side elevational view of an entire earring construction which includes on the display side of the body 10 and frame 11 a gem stone 14 mounted thereto in conventional fashion and further showing the post 13 mounted into the center threaded female receptor **12*b***.

In actual use, and particularly in the initial fitting of the earring to an individual user, the post 13 would be engaged with one of the three receptors **12*a*, 12*b* and 12*c* and projected through the pierced ear lobe. The jeweler or person fitting the earring to the individual would then determine how far upward or downward the earring hangs relative to the ear lobe, as well as to adjust the earring so as not to unattractively tilt angularly inwardly or outwardly from desired vertical alignment. Depending, of course, on the particular structure and angularity of the user's ear lobe, the post 13 can be adjustably positioned in any one of the three or more receptors 12*a*, 12*b* and 12*c* until the optimum "fit" or alignment is observed. At that point, the post can be securely attached in fixed non-axially-slidable engagement with its associated receptor merely by screwing the post in firmly, and the earring then mounted to the user's ear lobe by attaching the usual spring loaded slip-on type lock washer 16** or by some other retaining means to keep the post from slipping out of the ear lobe during normal use.

Although the present invention has been described in some detail by way of illustration and example, it is understood that the scope of the invention and different and various embodiments thereof are limited only by the scope of the following claims. Without limitation, the post which, in its presently preferred form is specifically shown and described as being threadedly attached to the inner side of the ornament support could also be alternatively mounted in alternate spaced positions by other means of attachment, such as by press-fitting the post end into tapered holes, providing a bayonet type attachment, gluing the post in a suitably-sized receptor, soldering, or the like.

What is claimed is:

1. An improved earring construction for pierced ears of the type having a display side adapted to overlie at least a portion of the outer side of an ear lobe to which it is attached, the combination comprising:

a support body having an outer display side and an inner side adapted to overlie at least a portion of the outer side of a user's pierced ear lobe to which it is attached;

said support body comprising a ring type main body and a diametrically oriented frame member attached for mounting and supporting an outwardly facing display object;

a post projecting from the inner side of said frame adapted to be extended through a user's pierced ear lobe from the outside to the inner side of said lobe;

means located on the inner side of said diametrically oriented frame member for supporting said post in a plurality of alternative vertically spaced positions relative to the ear lobe to permit positioning of the display side of the earring relatively upwardly or downwardly in reference to and overlying at least a portion of said pierced ear lobe through which the said post projects.

2. The combination of claim 1 and wherein said means located on said inner side of said support body comprises a plurality of vertically spaced receptors shaped and sized to alternatively receive and retain the inner end of said post when fitted therein in fixed non-slidable engagement.

3. The combination of claim 2 and wherein the inner end of said post is threaded, and wherein said receptors are each provided with female complementary threads each operable to tightly threadedly receive and retain the inner threaded post end.

* * * * *